United States Patent [19]

Beger

[11] Patent Number: 4,683,600

[45] Date of Patent: Aug. 4, 1987

[54] FOLDING CHILD'S BED

[75] Inventor: Udo Beger, Landshut, Fed. Rep. of Germany

[73] Assignee: Kurt Gotz, Fed. Rep. of Germany

[21] Appl. No.: 778,789

[22] Filed: Sep. 23, 1985

[30] Foreign Application Priority Data

Sep. 27, 1984 [DE] Fed. Rep. of Germany ..... 3435529

[51] Int. Cl.[4] ..... A47C 29/00

[52] U.S. Cl. ..... 5/99 C

[58] Field of Search ..... 5/93 R, 99 R, 99 A, 5/99 C; 135/75, 107, 108; 403/80, 393; 52/721, 127.1, 2; 248/432, 188; 108/297; 182/209, 210

[56] References Cited

U.S. PATENT DOCUMENTS

| | | | |
|---|---|---|---|
| 655,246 | 8/1900 | Kingsley | 182/210 |
| 2,513,889 | 7/1950 | Nilsson | 403/393 X |
| 2,634,942 | 4/1953 | Hughes | 403/393 |
| 4,044,411 | 8/1977 | Peterson | 5/99 A |
| 4,299,306 | 11/1981 | Hawkins | 182/210 |
| 4,455,697 | 6/1984 | Rovida | 5/99 C |

FOREIGN PATENT DOCUMENTS

| | | | |
|---|---|---|---|
| 187530 | 10/1922 | United Kingdom | 403/393 |

*Primary Examiner*—Carl D. Friedman
*Assistant Examiner*—Naoko N. Slack
*Attorney, Agent, or Firm*—Arnold, White & Durkee

[57] ABSTRACT

This invention relates to a folding child's bed comprising a respective upper and lower frame, each being about horizontal and foldable. The frames are connected via diagonal struts which are variable with respect to their length, said diagonal struts being substantially parallel to each other and shortened when the child's bed is folded up. When the child's bed is used, they are obliquely disposed from the center portion of the upper frame to the outer portion of the lower frame and completely extended. To make handling of such a child's bed easier and, in particular, to make telescoping of the diagonal struts possible without any jamming, the diagonal struts comprise upper and lower struts disposed respectively in spaced and parallel relationship with each other and comprising at the joints thereof sliding guides which are provided on the struts and in which the struts are displaceably supported with respect to each other and are securable against displacement in the extended state.

9 Claims, 5 Drawing Figures

FOLDING CHILD'S BED

DESCRIPTION

Figure 1:
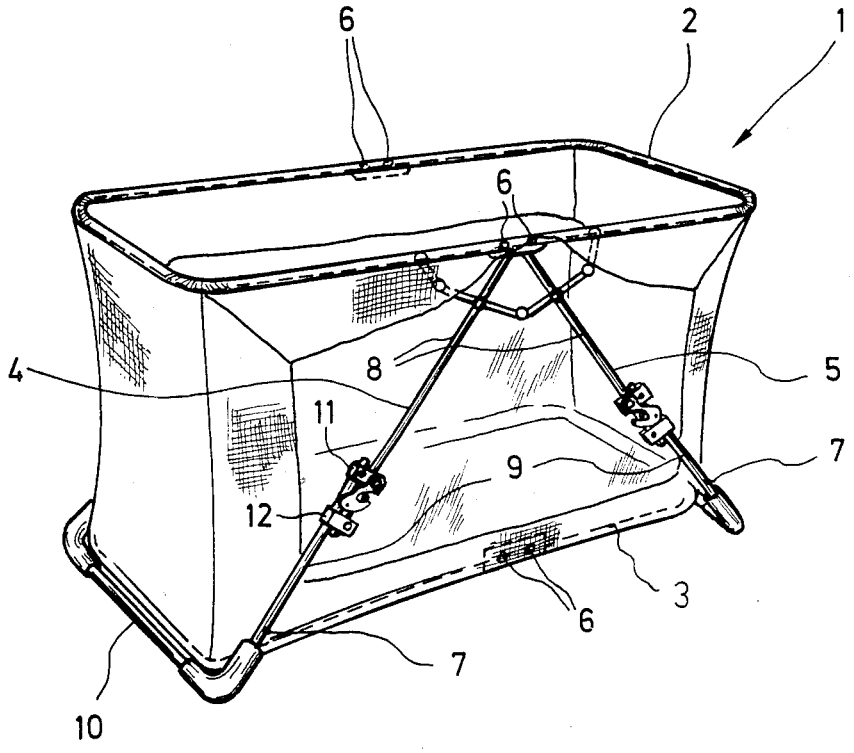

This invention relates to a folding child's bed comprising a respective upper and lower frame, each being about horizontal, foldable and connected via diagonal struts which are variable with respect to their length, the struts being substantially parallel to each other and shortened when the child's bed is folded up, and being obliquely disposed from the center portion of the upper frame to the outer portion of the lower frame and completely extended when the child's bed is used.

Such children's beds are already known from practical use. These children's beds are to be easily folding and when being folded up, they are only to take up a small space with the help of the displaceable diagonal struts so that they can be easily stowed away into the trunk of an automobile. The diagonal struts of these children's beds can be telescoped. These children's beds have the disadvantage that the diagonal struts get tilted or jammed when being telescoped. If one tries to telescope the diagonal struts by force, it may happen that, in doing so, they become easily bent. Then, however, the diagonal struts can no longer be telescoped so that compact folding of the child's bed can no longer be attained either. Furthermore, one of the struts must always be oversized so that the other struts can be slid thereinto.

In contrast thereto, it is the object of the invention to provide a folding child's bed of the type mentioned which is easy to handle and, in particular, ensures easy telescoping of the diagonal struts.

In order to attain this object, the invention provides that each of the diagonal struts comprises upper and lower struts disposed respectively in spaced and parallel relationship with each other and comprising at the joints thereof sliding guides which are provided on the struts and in which the struts are displaceably supported with respect to each other and are securable against displacement in the extended state.

This has the advantage that the struts are now displaced side by side with said struts being respectively guided at two points. Even bent struts can thereby still be telescoped although it is the risk of bending which is prevented by this kind of movability of the diagonal struts because even in the extended state of the diagonal struts, tilting or jamming of the same is excluded. Furthermore, it is possible to equally dimension the upper and lower struts.

Owing to the fact that a respective sliding guide is fastened to one of the upper struts and a sliding guide to one of the lower struts such that when the child's bed is used, the sliding guides are disposed adjacently and when the bed is folded up, away from each other, telescoping of the diagonal struts is even more simplified because during telescoping the two guide points move away from each other so that the lever arms with the help of which bending moments can be applied to the diagonal struts become smaller and smaller.

It is favorable that a pivotable bolt is respectively disposed on one of the sliding guides and a pin corresponding to the bolt on the associated, guided strut. The diagonal struts can thereby be easily secured against displacement in the extended state.

In this case, it is in particular favorable that the bolt is disposed in a suspended manner on the sliding guide provided on the lower strut and the pin on the upper strut below the bolt for the gravitational force thereby ensures that when the diagonal struts are extended, the bolt is always adjacent to the pin with its side assigned to the pin.

Since the upper struts are disposed in the center portion of the child's bed and surrounded by the lower struts when the child's bed is folded up, it is, on the one hand, made possible that the upper struts can be placed on the upper frame in a closely adjoining manner whereby the child's bed can be folded up in a very compact manner. On the other hand, this measure has also the effect that a closing moment always acts on the bolt which is disposed in a suspended manner, whereby the diagonal struts in the extended state are almost automatically locked.

It is favorable that the bolt is sickle-shaped and comprises at the convex side a recess inclined upwards and intended for the pin. In this case, the crescentic configuration of the bolt has a multiple function. On the one hand the above-mentioned closing moment is thereby further increased, on the other hand the convex side is used as a guide for the pin when the diagonal struts are extended until they reach their full length so that despite the increase in the closing moment it is still guaranteed that the bolt is adjacent to the pin with the intended side. Furthermore, the crescentic configuration of the bolt is of advantage when the diagonal struts are unlocked because the bolt can even then be easily gripped with the fingers when there is only a small distance with respect to the struts. The upwards inclined recess has the effect that the pin always remains in the locked position by reason of the dead weight of the child's bed alone, whereby unintended unlocking is prevented.

Figure 2:
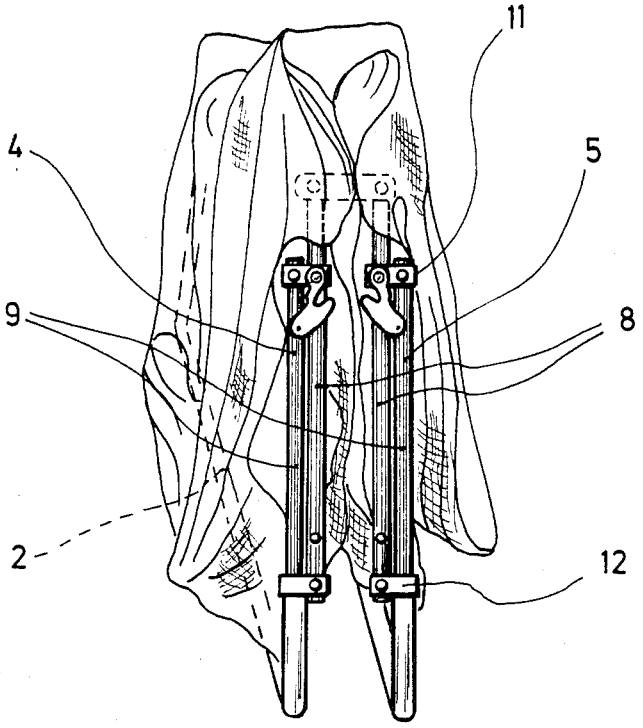
Figure 5:
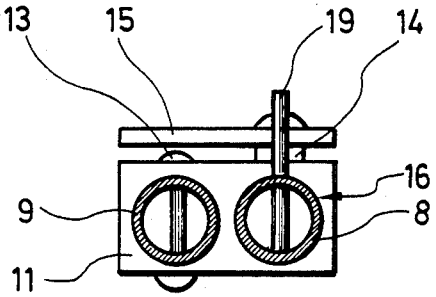
Figure 4:
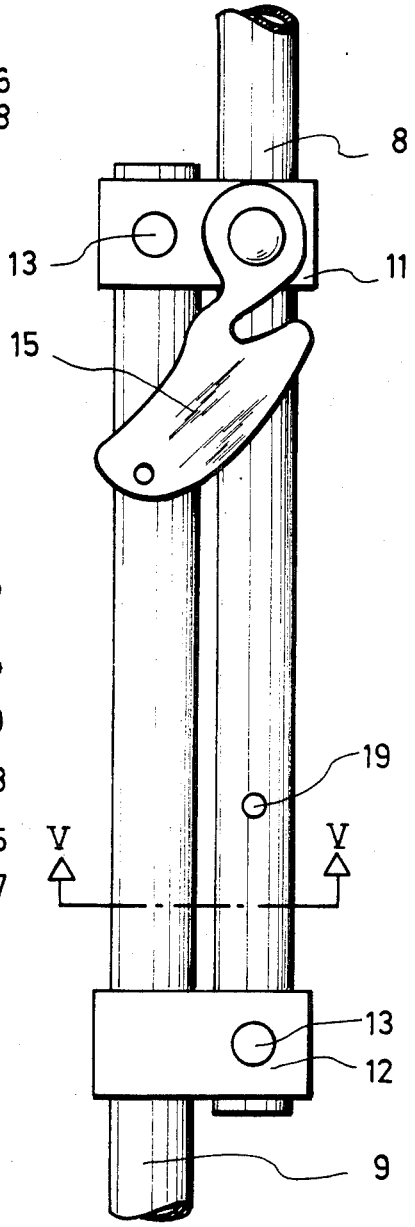
Figure 3:
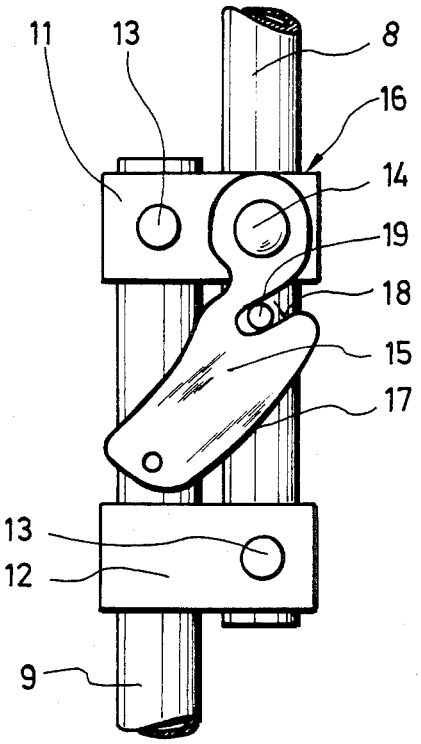

An embodiment of the invention shall now be explained in detail on the basis of drawings, wherein:

FIG. 1 shows a perspective view of a child's bed of the invention when it is used, FIG. 2 shows a perspective view of the child's bed when it is folded up, FIG. 3 shows a partial view of the diagonal strut when the child's bed is used, as is shown in FIG. 1, and FIG. 4 shows a partial view of the diagonal strut as is shown in FIG. 2, and FIG. 5 shows a sectional view through the diagonal strut along line V—V of FIG. 4.

As can best be seen from FIG. 1, the folding child's bed 1 comprises an upper frame 2 and a lower frame 3 which are articulated to each other by means of two diagonal struts 4 and 5.

The frames 2 and 3 are horizontal in the state of use of the child's bed shown in FIG. 1. In the case of the child's bed 1 which is here shown, the frames 2 and 3 consist of rectangularly bent round tubes which are pivotally connected to each other in a downward direction via hinges 6 at the longitudinal sides of the frames.

The diagonal struts 4 and 5 are articulated to the hinges 6 of the upper frame 2 and extend in a downward direction at an oblique angle outwards where they are then connected to the lower frame 3 by means of pivots 7. The diagonal struts 5 and 6 respectively comprise an upper strut 8 and a lower strut 9.

The struts 8 and 9 are also made of a round tube and the lower strut 9 has a U-bent shape so that the web of the U is used as a stand support 10 for the child's bed 1. The free ends of the lower strut 9 are respectively connected to the upper struts 8 in a displaceable manner by means of sliding guides 11 and 12.

As can even better be seen in FIG. 2, the upper struts 8 face each other whereas the lower struts 9 face the outer side of the child's bed 1.

FIG. 3 shows that one of the sliding guides 11 is fastened to the upper end of the lower strut (9) by means of a rivet 13. Likewise, the sliding guide 12 is provided on the lower end of the upper strut 8.

A crescentic bolt 15 which is pivotable about a pin 14 is provided at the side of the sliding guide 11 which faces away from the child's bed 1. The pin 14 is located above the guide hole 16 of the sliding guide 11. A recess 18 which is slightly inclined upwards is provided on the convex side 17 of the bolt.

A pin 19 is disposed on the upper strut 8 at a distance from the sliding guide 12 which approximately corresponds to the length of the bolt 15 from its recess 18 to its free end. As shown in FIG. 5, the pin 19 completely penetrates the upper strut 8 and is fixedly connected thereto. The size of the recess 18 is adapted to the pin 19.

Handling of the child's bed 1 and mode of operation of the invention shall now be explained in detail. The child's bed 1 is first in the folded state shown in FIG. 2. The diagonal struts 4 and 5 are telescoped such that the two sliding guides 11 and 12 are away from each other. First of all, the diagonal struts 4 and 5 are inclined by folding up the upper frame 2 which still faces downwards, whereupon the struts extend when the upper frame 2 is further folded up. In so doing, the sliding guides 11 and 12 fastened to the struts 8 and 9 move towards each other. Consequently, bolt 15 approaches the pin 19 at the same time. It is guaranteed by the crescentic configuration of the bolt 15 that when the diagonal struts 4 and 5 are further extended, the convex side 17 of the bolt 15 always comes into contact with the pin 19. The pin 19 is thereby always located at the side comprising the recess 19. If the diagonal struts 4 and 5 are still further extended, the bolt 15 is pivoted outwards by the pin 19 until the recess 19 encompasses the pin 19. The pin 19 automatically engages the recess 18, and this engagement is furthered by the fact that the crescentic configuration of the bolt 15 always effects an increased closing moment.

After the pin 19 has snapped into the recess 18, the child's bed 1 is in the use position shown in FIG. 1. Owing to the weight of the upper frame and the tension of the fabric sides of the child's bed which are not shown in this embodiment, the pin 19 is securely pressed into the recess 18. To bring the child's bed from the use position back into the folded state, the crescentic bolt 15 is first pivoted outwards so that the pins 19 are no longer in engagement with the recesses 18. The tension of the fabric (not shown) for the sides of the child's bed has the effect that the pins (19) do not again fall back into the recesses 18 of the bolts 15 but are adjacent to the convex side 17 of the bolts 15. The diagonal struts 4 and 5 are again oriented in parallel relationship with each other by folding up the center portion of the lower frame and by folding down the upper frame 2.

If the upper struts are now pushed downwards from above, the diagonal struts 4 and 5 telescope whereupon the child's bed 1 is in the folded state shown in FIG. 2.

In the embodiment which is here shown, the sliding guides consist of a plastic material, whereby lubrication of the sliding guides can be dispensed with and guiding without any jamming is guaranteed.

Instead of a child's bed, this invention can also be used for a folding playpen and suchlike.

I claim:

1. A folding child's bed comprising a respective upper and lower frame, each being about horizontal, foldable and connected via diagonal struts which are variable with respect to their length, said diagonal struts being substantially parallel to each other and shortened when said child's bed is folded up, and being obliquely disposed from the center portion of said upper frame to the outer portion of said lower frame and completely extended when said child's bed is used, characterized in that each of said diagonal struts (4, 5) comprises upper and lower struts (8, 9) disposed respectively in spaced and parallel relationship with each other and comprising at the joints thereof sliding guides (11, 12) which are provided on said struts (8, 9) and in which said struts (8, 9) are displaceably supported with respect to each other and are securable against displacement in the extended state by a pivotable bolt plate that is respectively disposed on one of said sliding guides and a pin corresponding to said bolt plate on the associated, guided strut.

2. A child's bed according to claim 1, characterized in that a respective sliding guide (12) is fastened to one of said upper struts (8) and a respective sliding guide (11) to one of said lower struts (9) such that when said child's bed (1) is used, said sliding guides (11, 12) are disposed adjacently and when said bed is folded up, said sliding guides are disposed away from each other.

3. A child's bed according to claim 2, wherein said bolt plate is disposed in a suspended manner on said sliding guide provided on said lower strut, and said pin is located on said upper strut below said bolt plate.

4. A child's bed according to claim 1, wherein when said child's bed is folded up, said upper struts are disposed in the center portion of said child's bed, being surrounded by said lower struts.

5. A child's bed according to at least one of claims 1 to 4, wherein said bolt plate is sickle-shaped and includes a convex side having a recess which is inclined upwards and intended to receive said pin.

6. A folding child's bed comprising a pair of extendable diagonal support struts, each support strut having upper and lower struts disposed in spaced parallel relationship with each other by means of fixed upper and lower sliding guides respectively securely attached to said upper and lower struts; and means positioned in association with said diagonal struts for securing said upper and lower struts against respective shortening displacement while in their extended state.

7. A child's bed according to claim 6 wherein the securing means is further defined as comprising a pin positioned on said upper strut above the sliding guide attached to said upper strut and a bolt plate pivotably disposed on the sliding guide attached to said lower strut, the bolt plate having a recess to receive said pin, wherein when said struts are extended, the bolt plate is pivotable to receive said pin in said recess to secure said upper strut against downward displacement relative to said lower strut.

8. A child's bed according to claim 7 wherein when said bed is folded up, said upper struts are centrally disposed with respect to said lower struts.

9. A child's bed according to claim 7 or 8 wherein said bolt plate is sickle-shaped and includes a convex side having a recess which is inclined upwards to receive said pin.

* * * * *